US011435682B2

(12) United States Patent
Samei et al.

(10) Patent No.: US 11,435,682 B2
(45) Date of Patent: Sep. 6, 2022

(54) HEATER, FIXING DEVICE, AND IMAGE FORMING APPARATUS

(71) Applicants: Masahiro Samei, Kanagawa (JP); Tomoya Adachi, Kanagawa (JP); Yuusuke Furuichi, Kanagawa (JP); Yukimichi Someya, Saitama (JP); Daisuke Inoue, Tokyo (JP)

(72) Inventors: Masahiro Samei, Kanagawa (JP); Tomoya Adachi, Kanagawa (JP); Yuusuke Furuichi, Kanagawa (JP); Yukimichi Someya, Saitama (JP); Daisuke Inoue, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/860,245

(22) Filed: Apr. 28, 2020

(65) Prior Publication Data

US 2020/0401067 A1 Dec. 24, 2020

(30) Foreign Application Priority Data

Jun. 19, 2019 (JP) ..... JP2019-113683

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
See application file for complete search history.

(56) References Cited

U.S. PATENT DOCUMENTS

| | | | | |
|---|---|---|---|---|
| 6,469,279 | B1 * | 10/2002 | Ohtsuka | G03G 15/2064 219/216 |
| 9,354,570 | B2 * | 5/2016 | Arimoto | G03G 15/2053 |
| 2018/0246443 | A1 * | 8/2018 | Tsunoda | G03G 15/2039 |
| 2019/0179242 | A1 | 6/2019 | Adachi et al. | |
| 2019/0196374 | A1 | 6/2019 | Adachi et al. | |
| 2019/0278206 | A1 | 9/2019 | Adachi et al. | |
| 2019/0286028 | A1 | 9/2019 | Furuichi et al. | |
| 2019/0286029 | A1 | 9/2019 | Adachi et al. | |
| 2020/0033766 | A1 | 1/2020 | Hase et al. | |
| 2020/0033771 | A1 | 1/2020 | Furuichi et al. | |
| 2020/0103797 | A1 | 4/2020 | Furuichi | |
| 2020/0117124 | A1 | 4/2020 | Furuichi | |

FOREIGN PATENT DOCUMENTS

JP 2019-012634 1/2019

* cited by examiner

*Primary Examiner* — Arlene Heredia
(74) *Attorney, Agent, or Firm* — Harness, Dickey & Pierce. P.L.C.

(57) ABSTRACT

A heater includes a base, a plurality of heat generators arranged on the base in parallel to a longitudinal direction of the base, a plurality of electrodes on the base, and conductor paths disposed on the base. The conductor paths are electrically connected to the heat generators and the electrodes. The conductor paths include a main conductor path connected to one of the electrodes and a branch conductor path branched from the main conductor path. At least a part of the branch conductor path has a lower electrical resistance per unit length than an electrical resistance per unit length of the main conductor path.

18 Claims, 8 Drawing Sheets

HEATER, FIXING DEVICE, AND IMAGE FORMING APPARATUS

CROSS-REFERENCE TO RELATED APPLICATION

This patent application is based on and claims priority pursuant to 35 U.S.C. § 119 to Japanese Patent Application No. 2019-113683, filed on Jun. 19, 2019 in the Japan Patent Office, the entire disclosure of which is hereby incorporated by reference herein.

BACKGROUND

Technical Field

Embodiments of the present disclosure generally relate to a heater, a fixing device, and an image forming apparatus. In particular, the embodiments of the present disclosure relate to a heater, a fixing device with the heater for fixing a toner image on a recording medium, and an image forming apparatus with the fixing device for forming an image on a recording medium.

Background Art

In one type of heater to heat a fixing rotator, the heater includes a base and a plurality of heat generators arranged in a longitudinal direction of the base, and changes heating a recording medium passing through a fixing nip to match a width of the recording medium.

In such a heater, having a uniform temperature distribution in a longitudinal direction of the fixing rotator is important to uniformly heat the recording medium in a width direction of the recording medium.

SUMMARY

This specification describes an improved heater that includes a base, a plurality of heat generators arranged on the base in parallel to a longitudinal direction of the base, a plurality of electrodes on the base, and conductor paths disposed on the base. The conductor paths are electrically connected to the heat generators and the electrodes. The conductor paths include a main conductor path connected to one of the electrodes and a branch conductor path branched from the main conductor path. At least a part of the branch conductor path has a lower electrical resistance per unit length than a resistance per unit length of the main conductor path.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
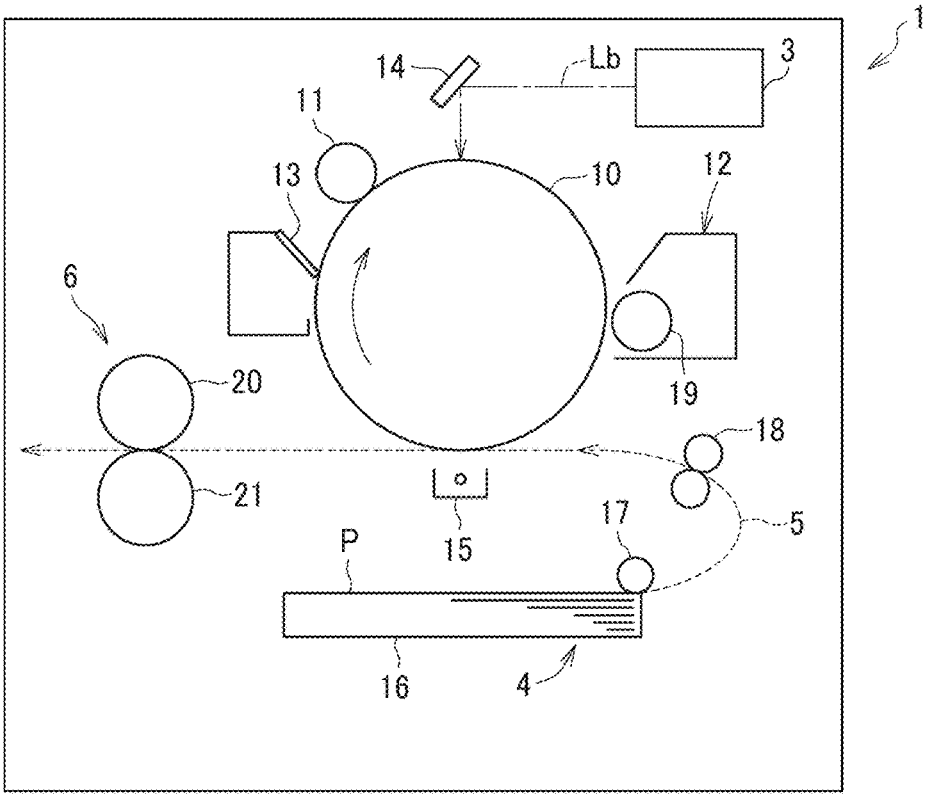
FIG. 1 is a schematic diagram illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

Referring to the drawings, embodiments of the present disclosure are described below. Identical reference numerals are assigned to identical components or equivalents and a description of those components is simplified or omitted.

As illustrated in FIG. 1, a monochrome image forming apparatus 1 includes a photoconductor drum 10. The photoconductor drum 10 is a drum-shaped rotator that bears toner as a developer of a toner image on an outer circumferential surface of the photoconductor drum 10 and rotates in a direction indicated by arrow in FIG. 1.

Around the photoconductor drum 10, the image forming apparatus 1 includes a charging roller 11 to uniformly charge the surface of the photoconductor drum 10, a developing device 12 including a developing roller 19 to supply toner to the surface of the photoconductor drum 10, and a cleaning blade 13 to clean the surface of the photoconductor drum 10.

In addition, the image forming apparatus 1 includes an exposure device 3. The exposure device 3 irradiates the surface of the photoconductor drum 10 with a laser light Lb based on the image data via a mirror 14.

The image forming apparatus 1 includes a transfer device 15 including a transfer charger opposite the photoconductor drum 10. The transfer device 15 transfers the toner image on the surface of the photoconductor drum 10 to a sheet P.

A sheet feeder 4 is disposed in a lower portion of the image forming apparatus 1. The sheet feeder 4 includes a sheet tray 16, which contains sheets P as recording media, and a sheet feeding roller 17 to feed the sheets P from the sheet tray 16 to a conveyance path 5. Downstream from the sheet feeding roller 17 in a sheet conveyance direction, registration rollers 18 are disposed.

The fixing device 6, described in detail later, includes a fixing belt 20 heated by a heater and a pressure roller 21 that presses against the fixing belt 20.

The basic operation of the image forming apparatus 1 is described with reference to FIG. 1.

At the beginning of an image forming operation, the photoconductor drum 10 rotates, and the charging roller 11 charges the surface of the photoconductor drum 10. Based on image data, the laser light L is emitted from the exposure device 3 to the charged surface of the photoconductor drum 10, so that the electric potential at the emitted portions on the surface of the photoconductor drum 10 decreases to form an electrostatic latent image. The developing device 12 supplies toner to the electrostatic latent image formed on the surface of photoconductor drum 10 to visualize the electrostatic latent image into a toner image, that is, a developer image. The transfer device 15 transfers the toner image onto the sheet P, and the cleaning blade 13 removes the toner remaining on the photoconductor drum 10.

On the other hand, as the image forming operation starts, the sheet feeding roller 17 of the sheet feeder 4 disposed in the lower portion of the image forming apparatus 1 is driven and rotated to feed the sheet from the sheet tray 16 toward the registration rollers 18 through the conveyance path 5.

The registration rollers 18 are controlled to convey the sheet P fed to the conveyance path 5 to an image transfer position at which the transfer device 15 faces the photoconductor drum 10 so that the sheet P meets the toner image formed on the surface of the photoconductor drum 10, and the transfer charger in the transfer device 15 applied a transfer bias transfers the toner image onto the sheet P at the image transfer position.

The sheet P bearing the toner image is conveyed to the fixing device 6 in which the fixing belt 20 and the pressure roller 21 fix the toner image onto the sheet P under heat and pressure. The sheet P bearing the fixed toner image thereon is separated from the fixing belt 20, conveyed by a conveyance roller pair disposed downstream from the fixing device 6, and ejected to an output tray disposed outside the image forming apparatus 1.

The fixing device 6 according to a first embodiment of the present disclosure is described with reference to FIG. 2.

Figure 2:
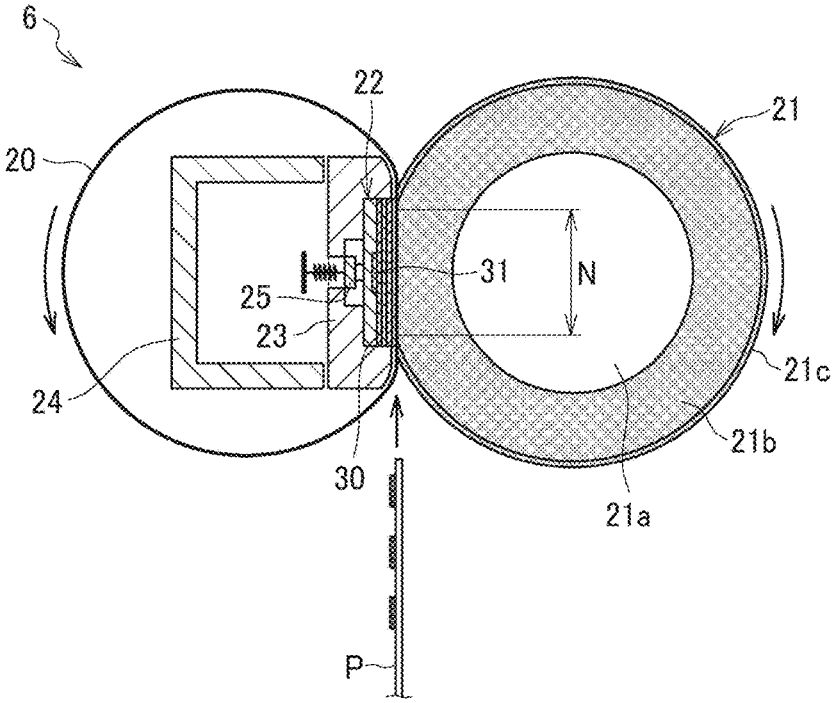
FIG. 2 is a schematic diagram illustrating a configuration of a fixing device according to an embodiment of the present disclosure.

As illustrated in FIG. 2, the fixing device 6 according to the present embodiment includes an endless fixing belt 20 as a first rotator, the pressure roller 21 as a second rotator that contacts the outer circumferential surface of the fixing belt 20 to form a fixing nip N, a heater 22 to heat the fixing belt 20, a heater holder 23 as a holding member to hold the heater 22, a stay 24 as a support to support the heater holder 23, and a thermistor 25 as a temperature detector to detect a temperature of the heater 22.

The fixing belt 20 includes, for example, a tubular base made of polyimide (PI), the tubular base having an outer diameter of 25 mm and a thickness of from 40 to 80 μm. The fixing belt 20 further includes a release layer as an outermost surface layer. The release layer is made of fluororesin, such as tetrafluoroethylene-perfluoroalkylvinylether copolymer (PFA) and polytetrafluoroethylene (PTFE), and has a thickness of from 5 μm to 20 μm to enhance durability of the fixing belt 20 and facilitate separation of the sheet P from the fixing belt 20. An elastic layer made of rubber having a thickness of from 50 to 200 μm may be provided between the base and the release layer. The base of the fixing belt 20 may be made of heat resistant resin such as polyetheretherketone (PEEK) or metal such as nickel (Ni) or stainless steel (SUS), instead of polyimide. An inner circumferential surface of the fixing belt 20 may be coated with polyimide, polytetrafluoroethylene (PTFE), or the like to produce a slide layer.

The pressure roller 21 has an outer diameter of 25 mm, for example. The pressure roller 21 includes a cored bar 21*a*, an elastic layer 21*b*, and a release layer 21*c*. The cored bar 21*a* is solid and made of metal such as iron. The elastic layer 21*b* coats the cored bar 21*a*, The release layer 21*c* coats an outer surface of the elastic layer 21*b*. The elastic layer 21*b* is made of silicone rubber and has a thickness of 3.5 mm, for example. In order to facilitate separation of the sheet P and the foreign substance from the pressure roller 21, the release layer 21*c* that is made of fluororesin and has a thickness of about 40 micrometers, for example, is preferably disposed on the outer surface of the elastic layer 21*b*.

A biasing member presses the pressure roller 21 against the fixing belt 20, and the pressure roller 21 presses against the heater 22 via the fixing belt 20 to form the fixing nip N between the fixing belt 20 and the pressure roller 21. A driver drives and rotates the pressure roller 21 in a direction of an arrow illustrated in FIG. 2, and this rotation of the pressure roller 21 rotates the fixing belt 20.

The heater 22 is a planar heating member extending in a longitudinal direction of the fixing belt 20 that is also a longitudinal direction of the heater 22 or the heater holder 23 and a direction perpendicular to the surface of the sheet on which FIG. 2 is illustrated. The heater 22 includes a planar base 30, resistance heat generators 31 disposed on the base 30, and a protective insulation layer covering the resistance heat generators 31. The heater 22 contacts the inner circumferential surface of the fixing belt 20, and the heat generated from the resistance heat generator 31 is transmitted to the fixing belt 20 through the protective insulation layer or the like.

The heater holder 23 and the stay 24 are disposed inside the inner circumferential surface of the fixing belt 20. The stay 24 is configured by a channeled metallic member, and both side plates of the fixing device 6 support both end portions of the stay 24. Since the stay 24 supports the heater holder 23 and the heater 22 held by the heater holder 23, the heater 22 reliably receives a pressing force of the pressure roller 21 pressed against the fixing belt 20 and stably forms the fixing nip N.

The heater holder 23 is preferably made of heat-resistant material because heat from the heater 22 heats the heater holder 23 to a high temperature. The heater holder 23 made of heat-resistant resin having low thermal conduction, such as a liquid crystal polymer (LCP), reduces heat transfer from the heater 22 to the heater holder 23 and provides efficient heating of the fixing belt 20.

When printing starts in the fixing device 6 according to the present embodiment, the pressure roller 21 is driven to rotate, and the fixing belt 20 starts to be rotated. As power is supplied to the resistance heat generator 31 of the heater 22, the heater 22 heats the fixing belt 20. After the temperature of the fixing belt 20 reaches a predetermined target temperature (i.e., fixing temperature), the sheet P bearing an unfixed toner image is conveyed to the nip N between the fixing belt 20 and the pressure roller 21, and the unfixed toner image is heated and pressed on to the sheet P and fixed thereon.

The heater 22 is described in detail below.

Figure 3A:
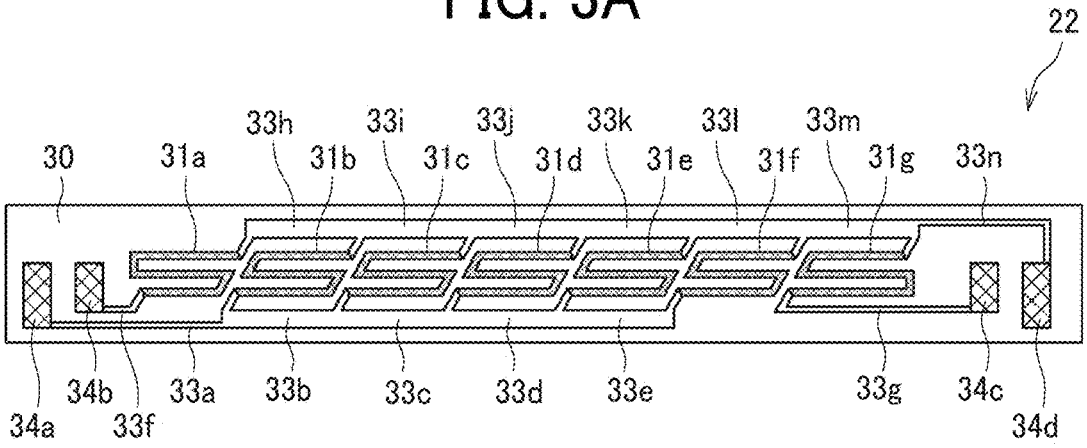
FIG. 3A is a front view illustrating a heater according to a first embodiment of the present disclosure provided in the fixing device of FIG. 1.

As illustrated in FIG. 3A, over the base 30 that is a long plate, there are resistance heat generators 31*a* to 31*g* as heat generators, conductor paths 33*a* to 33*n*, and electrodes 34*a* to 34*d*, which are arranged in the longitudinal direction of the base 30, in addition to the protective layer and the like. The electrodes 34*a* and 34*b* are disposed on one end portion of the base 30 in the longitudinal direction of the base 30, and the electrodes 34*c* and 34*d* are disposed on the other end portion in the longitudinal direction of the base 30. In the present embodiment, a glass protective layer, described below, is disposed on the surface of the base 30, and the resistance heat generators and other components are disposed on the glass protective layer. The conductor paths 33*b* to 33*e* and the conductor paths 33*h* to 33*m* are specific sections each of which connects adjacent resistance heat generators and given by dividing conductor paths extending in a lateral direction in FIG. 3A to the specific sections. For example, the conductor path 33*b* is a section that connects the resistance heat generator 31*b* and the resistance heat generator 31*c* in the conductor path extending in the lateral direction in FIG. 3A and continuously connected to the conductor path 33*a*.

The material of the base 30 is preferably ceramic such as alumina and aluminum nitride or heat-resistant resin material such as glass, mica, and polyimide (PI) because of their excellent heat resistance and insulation. In the present embodiment, the base 30 is made of insulating material.

The resistance heat generators and the conductor paths are constructed of conductive material prepared by mixing silver (Ag), palladium (Pd), platinum (Pt), ruthenium oxide (RuO2), or the like.

In the present embodiment, a configuration of each of the resistance heat generators 31*a* to 31*g* is an elongated turned-back serpentine line configuration. Such a configuration can generate a required heat amount even if an inexpensive material having a low electrical resistance is used for the resistance heat generators 31 to reduce the cost of the heater 22. The turned-back portion of the resistance heat generators 31*a* to 31*g* can be extended and inclined, which enables the adjacent resistance heat generators to overlap in the longitudinal direction of the base 30 to reduce unevenness of temperatures of the heater 22 in the longitudinal direction.

The electrodes 34*a* to 34*d* contact a connector to electrically connect the heater 22 to a power supply disposed outside the heater 22.

In the present embodiment, the conductor paths and the like are formed by screen-printing materials on the insulating glass layer formed on the surface of the base 30 and subsequently firing.

The electrode 34*a* is electrically connected to the resistance heat generators 31*b* to 31*f* via the conductor path 33*a* and the conductor paths 33*b* to 33*e*. The electrode 34*b* is connected to the resistance heat generator 31*a* via the conductor path 33*f*. The electrode 34*c* is connected to the resistance heat generator 31*g* via the conductor path 33*g*. The electrode 34*d* is electrically connected to the resistance heat generators 31*a* to 31*g* via the conductor path 33*n* and the conductor paths 33*h* to 33*m*. The conductor paths 33*a*, 33*f*, 33*g*, and 33*n* are main conductor paths directly connected to the electrodes 34*a*, 34*b*, 34*c*, and 34*d*, respectively. The conductor paths 33*b* to 33*e* and the conductor paths 33*h* to 33*m* are branch conductor paths branched from the main conductor path. In the present embodiment, the branch conductor paths are connected to the resistance heat generators 31*a* to 31*g*.

Figure 3B:
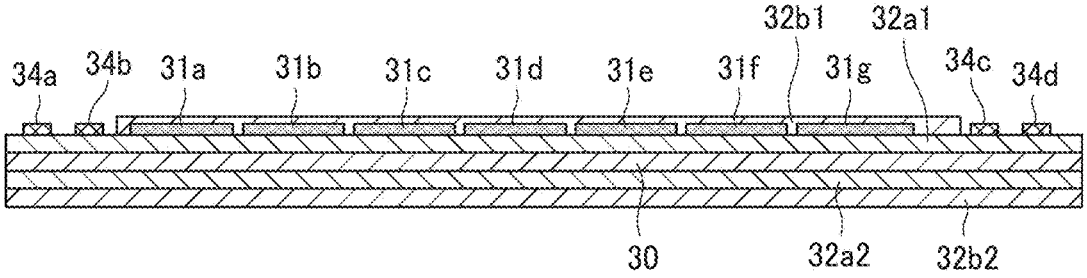
FIG. 3B is a plan view illustrating the heater according to the first embodiment of the present disclosure provided in the fixing device of FIG. 1.

As illustrated in FIG. 3B, the heater 22 has a multilayer structure including an insulating glass layer 32*a*1 that is an upper layer on the base 30, an insulating glass layer 32*a*2 that is a lower layer below the base 30, an insulating protective layer 32*b*1 that is an upper layer on the insulating glass layer 32*a*1, and an insulating protective layer 32*b*2 below the insulating glass layer 32*a*2.

The above-described resistance heat generators 31 and the like are disposed on the base 30 via the insulating glass layer 32*a*1 that provides insulation between the base 30 and each of the resistance heat generators 31 and the like. In addition, the insulating protective layer 32*b*1 covers the surface of the insulating glass layer 32*a*1, the resistance heat generators 31, and the conductor paths. The insulating glass layer 32*a*2 and the insulating protective layer 32*b*2 cover the front side of the base 30 to ensure insulation and slidability with the fixing belt 20.

The insulating protective layers 32*b*1 and 32*b*2 are preferably made of ceramics such as alumina and aluminum nitride, glass, mica, and heat-resistant resin such as polyimide because of excellent heat resistance and insulation properties.

Figure 4:
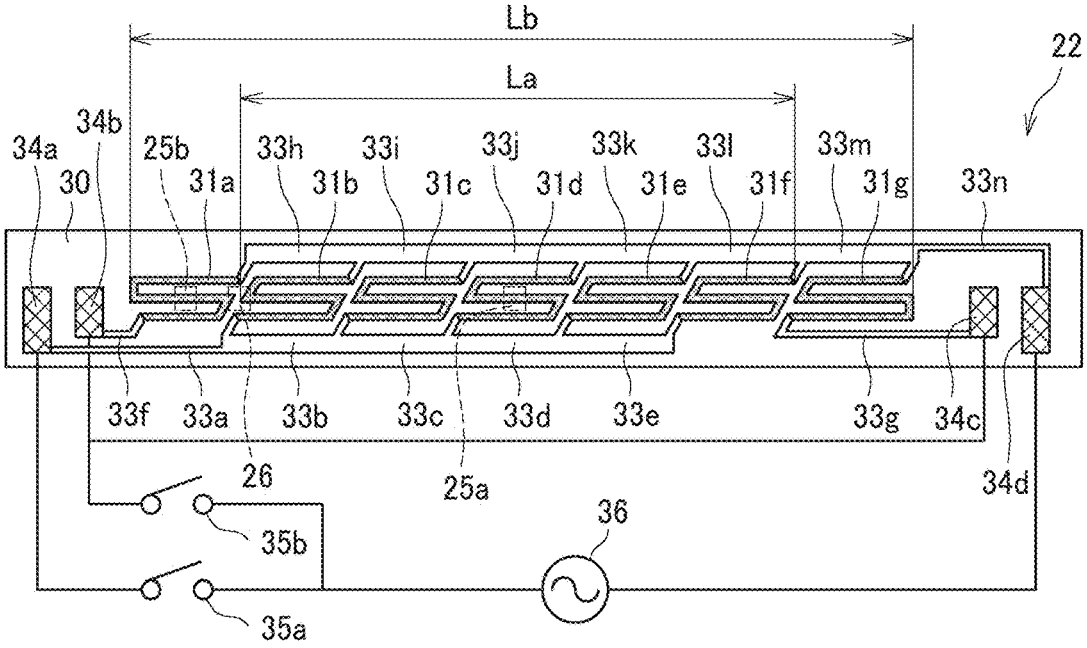
FIG. 4 is a schematic diagram illustrating a circuit to supply power to the heater according to the first embodiment.

As illustrated in FIG. 4, the electrode 34*a* connected to the resistance heat generators 31*b* to 31*f* is electrically connected to a power supply 36 disposed outside the heater 22 via the connector or the like and a switch 35*a* as a switching unit. The electrode 34*b* connected to the resistance heat generator 31*a* and the electrode 34*c* connected to the resistance heat generator 31*g* are electrically connected to the power supply 36 disposed outside the heater 22 via the connector or the like and a switch 35*b* as the switching unit. In addition, the electrode 34*d* is electrically connected to the power supply 36 disposed outside the heater 22 by a connector or the like. In other words, the resistance heat generators 31*b* to 31*f* form a group of the resistance heat generators that is electrically switched on or off by the switch 35*a*, and the resistance heat generators 31*a* and 31*g* form a group of the resistance heat generators that is electrically switched on or off by the switch 35*b*.

Turning on the switch 35*a*, turning off the switch 35*b*, and supplying power from the power supply 36 supplies the power to the resistance heat generators 31*b* to 31*f*, and the heater 22 can heat the fixing belt 20 in a heat generation span La corresponding to a small-size sheet (for example, A4 size sheet placed vertically). Turning on the switches 35*a* and 35*b* and supplying power from the power supply 36 supplies the power to the resistance heat generators 31*a* to 31*g*, and the heater 22 can heat the fixing belt 20 in a heat generation span Lb corresponding to a large-size sheet (for example, A4 size sheet placed horizontally). Forming the heating generation span corresponding to each sheet width can reduce wasteful power consumption and prevent overheating in end portions of the fixing belt in a width direction of the fixing belt 20.

As illustrated in FIG. 4, on the back side of the heater 22 that is on the left side of the heater 22 in FIG. 2 and the side opposite to the fixing nip N, there are the thermistors 25*a* and 25*b* (also referred to collectively as the thermistors 25) to detect temperatures and a thermostat 26 to prevent overheating.

The thermistor 25*a* is disposed at a center portion of the heater 22 in the longitudinal direction of the heater 22, particularly, in the present embodiment, at a position corresponding to the resistance heat generator 31*d*. The thermistor 25*b* is disposed at an end portion of the heater 22 in the longitudinal direction of the heater 22, particularly, in the present embodiment, at a position corresponding to the resistance heat generator 31*a*. The thermistor 25*a* can detect a temperature at the center portion of the heater 22 in the longitudinal direction that is a temperature of the resistance heat generator 31*d*, one of the resistance heat generators 31*b* to 31*f*, and the thermistor 25*b* can detect a temperature at the end portion of the heater 22 in the longitudinal direction that is a temperature of the resistance heat generator 31*a*, one of the resistance heat generators 31*a* and 31*g*. Based on these temperatures, the heat amount of the heater 22 to heat the fixing belt can be controlled.

The thermostat 26 is disposed on the back side of the heater 22 so as to straddle the resistance heat generators 31*a* and 31*b*. The above-described configuration in which the thermostat 26 is disposed so as to straddle the group of the resistance heat generators and another group of the resistance heat generators to detect a temperature at a portion near the groups of the resistance heat generators can detect abnormality even when either one of the groups of resistance heat generators abnormally raises temperature and prevent the fixing belt from overheating.

Figure 5:
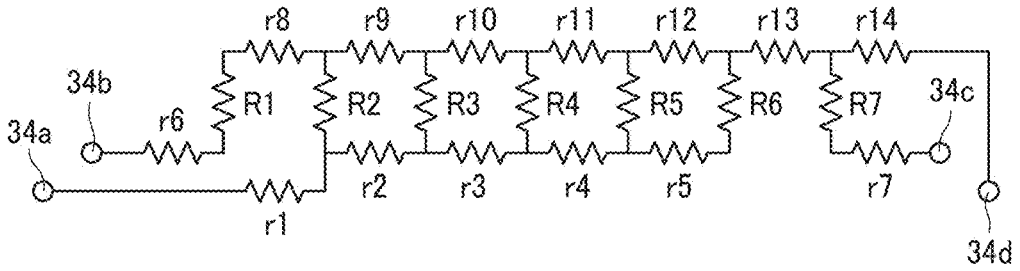
FIG. 5 is an equivalent electric circuit diagram of the heater according to the first embodiment.

FIG. 5 is an equivalent electric circuit diagram of the heater 22 according to the present embodiment. The resistance heat generators 31*a* to 31*g* in FIG. 4 correspond to resistances R1 to R7 in FIG. 5, respectively. The conductor paths 33*a* to 33*e* correspond to r1 to r5, the conductor path 33*f* corresponds to r6, the conductor path 33*g* corresponds to r7, and the conductor paths 33*h* to 33*n* correspond to r8 to r14, respectively.

With reference to FIG. 5, resistances between the electrodes when the power is supplied to the resistance heat generators 31*a* to 31*g* are described below. For example, a current path through which the power is supplied to the resistance heat generator 31*a* is:

the electrode 34*b*→ the conductor path 33*f*→ the resistance heat generator 31*a*→ the conductor paths 33*h* to 33*n*→ the electrode 34*d* (see FIG. 4).

Therefore, the resistance of the current path of the resistance heat generator 31*a* can be expressed as below.

$$31a{:}r6+R1+r8+r9+r10+r11+r12+r13+r14 \quad \text{(Formula 1)}$$

Resistances of the current paths through which the power is supplied to other resistance heat generators 31*b* to 31*g* are as follows.

$$31b{:}r1++R2+r9+r10+r11+r12+r13+r14 \quad \text{(Formula 2)}$$

$$31c{:}r1+r2+R3+r10+r11+r12+r13+r14 \quad \text{(Formula 3)}$$

$$31d{:}r1+r2+r3+R4+r11+r12+r13+r14 \quad \text{(Formula 4)}$$

$$31e{:}r1+r2+r3+r4+R5+r12+r13+r14 \quad \text{(Formula 5)}$$

$$31f{:}r1+r2+r3+r4+r5+R6+r13+r14 \quad \text{(Formula 6)}$$

$$31g{:}r7+R7+r14 \quad \text{(Formula 7)}$$

As described above, since the resistance heat generators have different current paths having different lengths, total resistances of the current paths are also different each other. The different total resistances of the current paths results in different voltages in the resistance heat generators and may cause uneven heat generation amounts of the resistance heat generators.

Figure 16:
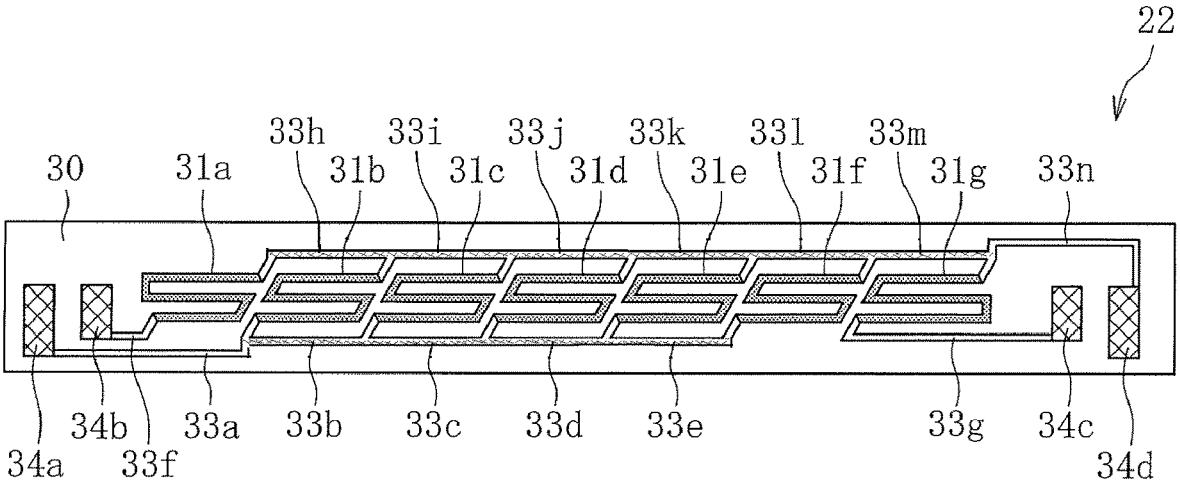
FIG. 16 is a front view illustrating a heater according to a first embodiment of the present disclosure provided in the fixing device of FIG. 1.

On the other hand, in the present embodiment, setting a resistance per unit length in the branch conductor path lower than a resistance per unit length in the main conductor path reduces temperature unevenness. That is, as illustrated in FIG. 4, increasing a vertical width (that is a length in a vertical direction in FIG. 4) of each of conductor paths 33*b* to 33*e* and 33*h* to 33*m* and a thickness (that is a length in a direction perpendicular to the surface of the sheet in FIG. 4) of each of conductor paths 33*b* to 33*e* and 33*h* to 33*m* causes a cross-sectional area (that is a cross-sectional area of a cross section cut in a direction perpendicular to the surface of the sheet in FIG. 4) larger than each of cross-sectional areas of the main conductor paths 33*a*, 33*f*, 33*g*, and 33*n*. The above-described configuration causes each of resistances of the main conductor paths 33*a*, 33*f*, 33*g*, and 33*n* to be relatively larger than each of resistances of the branch conductor paths 33*b* to 33*e* and 33*h* to 33*m*(FIG. 16). That is, each of the resistances r1, r6, r7, and r14 is larger than each of the other resistances.

In the above description, the length of the conductor path means the length of a line portion of the conductor path on a plane parallel to the base 30.

Extracting only resistance factors having large resistances from the formulas 1 to 7 gives following formulas:

$$31a{:}r6+R1+r14 \quad \text{(Formula 1')}$$

$$31b{:}r1+R2+r14 \quad \text{(Formula 2')}$$

$$31c{:}r1+R3\pm r14 \quad \text{(Formula 3')}$$

$$31d{:}r1+R4+r14 \quad \text{(Formula 4')}$$

$$31e{:}r1+R5+r14 \quad \text{(Formula 5')}$$

$$31f{:}r1+R6+r14 \quad \text{(Formula 6')}$$

$$31g{:}r7+R7+r14 \quad \text{(Formula 7')}.$$

Accordingly, the current paths of the resistance heat generators 31*a* to 31*g* have the same number of conductor paths having the large resistances, which can reduce differences in resistances between the electrodes that connect each of the resistance heat generators 31*a* to 31*g* supplied the power. Reducing the differences in resistances reduces differences in voltages applied to the resistance heat generators and can decrease unevenness in the amounts of heat generated by the resistance heat generators 31*a* to 31*g*. Thereby, the heater 22 can heat the fixing belt uniformly over its longitudinal direction. Therefore, the fixing device 6 can uniformly heat the surface of the sheet P over the longitudinal direction and fix the toner image onto the surface of the sheet P.

As described above, the current paths formed between electrodes inevitably pass through the main conductor paths that directly connect the electrode firstly or lastly. In contrast, the number of branch conductor paths existing in the middle of the current paths are different depending on the current path. Therefore, reducing the resistances of the branch conductor paths reduces the differences among the resistances of the current paths. In other words, in the present embodiment, reducing the resistance of the conductor path that causes a difference of length in the current paths of the resistance heat generators 31*a* to 31*g* decreases the differences among the resistances of the current paths.

As a method to increase the cross-sectional area of the conductor path, increasing the width of the conductor path can reduce the resistance of the branch conductor path without affecting the slidability of the surface of the heater 22.

Also, as in the present embodiment, the layout in which the electrodes 34*a* and 34*b* and the electrodes 34*c* and 34*d* are respectively disposed on both end portions of the base 30 in the longitudinal direction of the base 30 allows the current paths of the resistance heat generators 31*a* to 31*g* to be the path from the electrodes 34*a* and 34*b* on one end portion of the base 30 in the longitudinal direction of the heater 22 to the electrodes 34*c* and 34*d* on the other end portion of the base 30 in the longitudinal direction. That is, the above-described configuration does not need a turned-back portion of the conductor path, Therefore, removing the turned-back portion of the conductor path from the width in a short-side direction of the base 30 enables increasing a width of the branch conductor path to increase the cross-sectional area of the branch conductor path. In addition, the above-described configuration can shorten current paths.

Next, a description is given of variations of the heater 22, focusing on the differences from the first embodiment, and similar description to the first embodiment is omitted.

Figure 6:
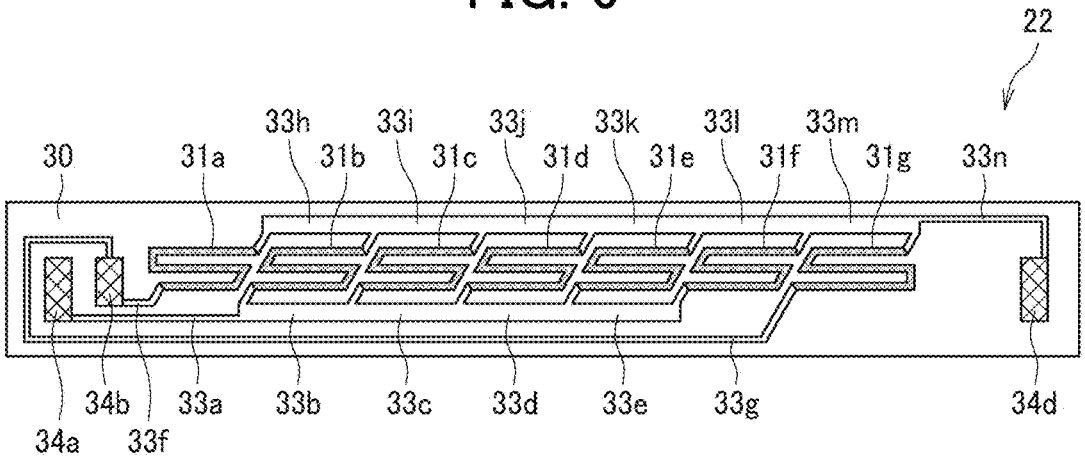
FIG. 6 is a front view illustrating the heater according to a second embodiment of the present disclosure.
Figure 7:
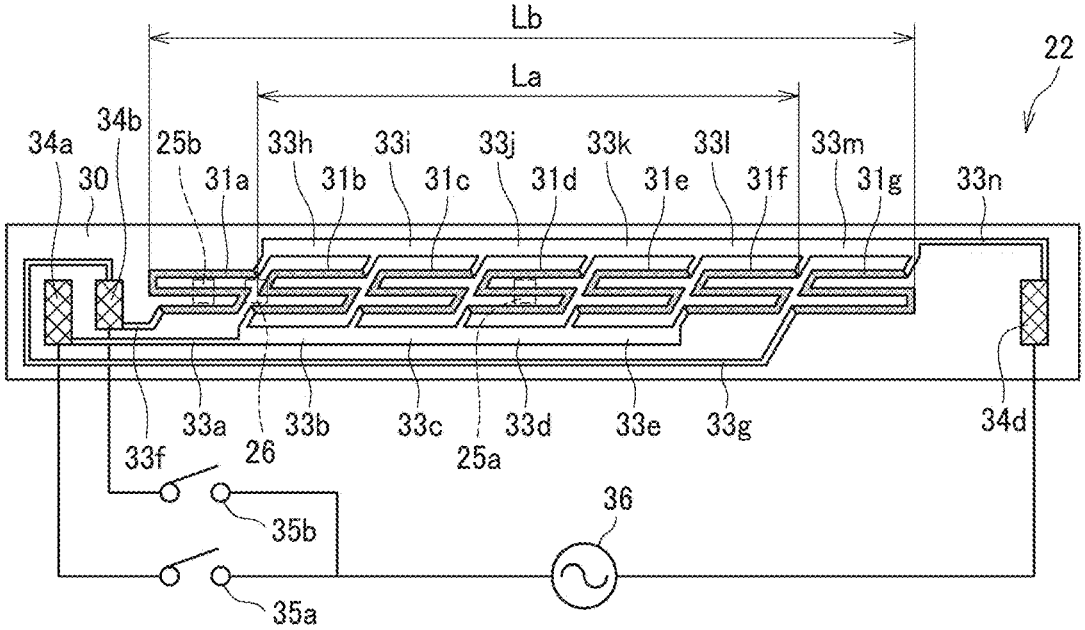
FIG. 7 is a schematic diagram illustrating a circuit to supply power to the heater according to the second embodiment.
Figure 8:
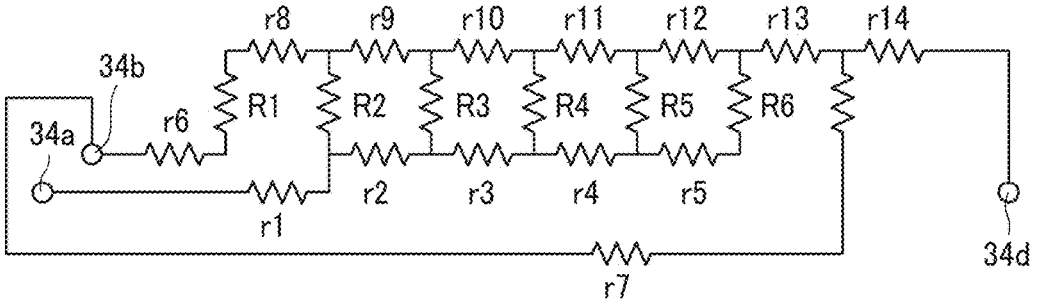
FIG. 8 is an equivalent electric circuit diagram of the heater according to the second embodiment.

As illustrated in FIG. 6, the heater 22 according to a second embodiment of the present disclosure includes only the electrode 34*d* disposed at end portion of the base 30 in the longitudinal direction and does not include the electrode 34*c*, which is a different point from the above-described heater 22 of the first embodiment. In the first embodiment, the electrode 34*c* is connected to the resistance heat generator 31*g* via the conductor path 33*g* as illustrated in FIG. 4. In the second embodiment, as illustrated in FIG. 6, the conductor path 33*g* extends from the other end portion of the base 30 in the longitudinal direction to the one end portion of the base 30 and connects the resistance heat generator 31*g* and the electrode 34*b*. As illustrated in FIG. 7, as in the first embodiment, the resistance heat generators 31*b* to 31*f* form the one group of the resistance heat generators that is electrically switched on or off by the switch 35*a*, and the resistance heat generators 31*a* and 31*g* form the other one group of the resistance heat generators that is electrically switched on or off by the switch 35*b*. That is, the heater 22 in the second embodiment can also switch two heat generation spans La and Lb. Note that FIG. 8 is an equivalent electric circuit diagram of the heater according to the second embodiment.

In the above-described heater 22, the resistances of the main conductor paths 33*a*, 33*f*, 33*g*, and 33*n* can be also designed to be relatively larger than the resistances of the branch conductor paths 33*b* to 33*e* and 33*h* to 33*m*, which reduce the difference between the heat generation amounts of the respective resistance heat generators 31*a* to 31*g*. In particular, the layout of the second embodiment can reduce the number of electrodes by one as compared with the layout of the first embodiment and simplify the configuration.

In the heater 22 of the first embodiment and the second embodiment described above, turning on and off the resistance heat generators 31*a* and 31*g* switches two heat generation spans La and Lb. However, three or more switchable heat generation spans may be designed. The heater according to a third embodiment of the present disclosure is described below focusing on differences from the heater of the first embodiment.

Figure 9:
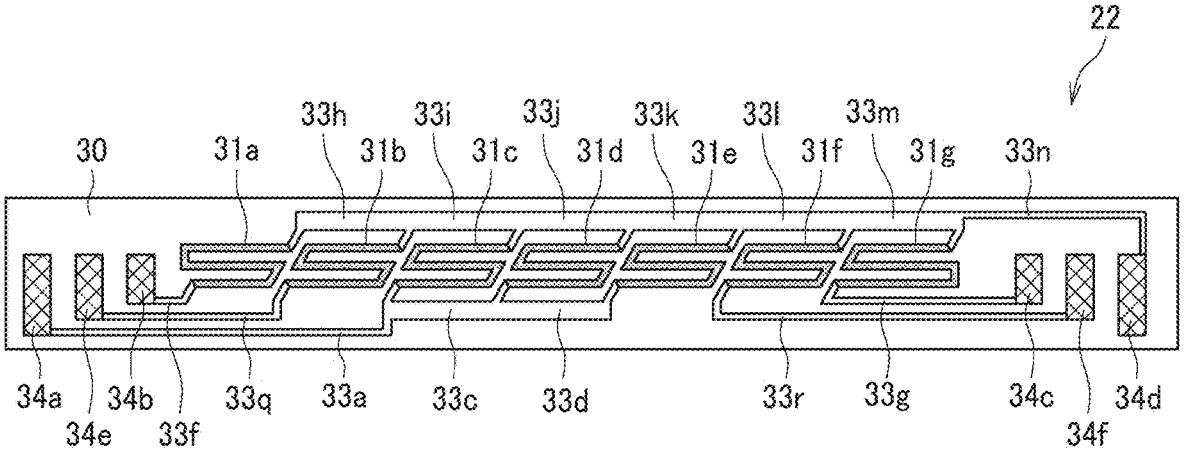
FIG. 9 is a front view illustrating the heater according to a third embodiment of the present disclosure.

As illustrated in FIG. 9, the heater 22 of the third embodiment includes an electrode 34*e* in addition to the electrodes 34*a* and 34*b* on one end portion of the base 30 in the longitudinal direction of the heater 22. Additionally, the heater 22 includes an electrode 34*f* in addition to the electrode 34*c* and 34*d* on the other end portion of the base 30 in the longitudinal direction.

The electrode 34*e* is connected to the resistance heat generator 31*b* via the conductor path 33*q*. The electrode 34*f* is connected to the resistance heat generator 31*f* via the conductor path 33*r*.

Figure 10:
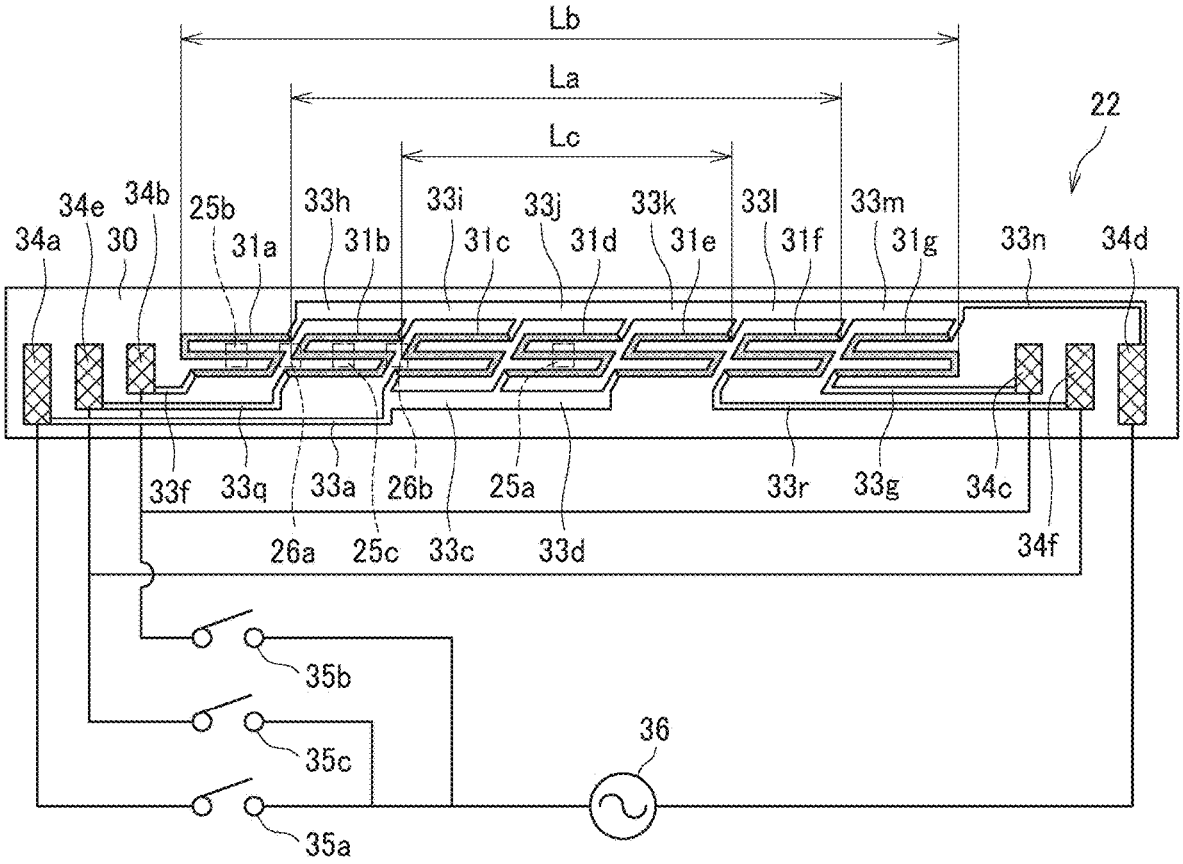
FIG. 10 is a schematic diagram illustrating a circuit to supply power to the heater according to the third embodiment.

As illustrated in FIG. 10, the electrode 34*e* connected to the resistance heat generator 31*b* and the electrode 34*f* connected to the resistance heat generator 31*f* are electrically connected to the power supply 36 disposed outside the heater 22 via the connector or the like and a switch 35*c* as the switching unit. Other components and connections in the third embodiment are the same as those in the first embodiment illustrated in FIG. 4. In other words, in the third embodiment, the resistance heat generators 31*c* to 31*e* form a group of the resistance heat generators that is electrically switched on or off by the switch 35*a*, the resistance heat generators 31*a* and 31*g* form a group of the resistance heat generators that is electrically switched on or off by the switch 35*b*, and the resistance heat generators 31*b* and 31*f* form a group of the resistance heat generators that is electrically switched on or off by the switch 35*c*.

In the third embodiment, the heater 22 can heat a heat generation span Lc in addition to the heat generation spans La and Lb in the longitudinal direction described above. That is, turning on the switch 35*a* and turning off the switches 35*b* and 35*c* can supply power to the resistance heat generators 31*c* to 31*e*, and the heating generation span can be set to a span Lc. Turning on the switches 35*a* and 35*c* and turning off the switch 35*b* can supply power to the resistance heat generators 31*b* to 31*f*, and the heat generation span can be set to the span La, Turning on all the switches can supply power to all the resistance heat generators 31*a* to 31*g*, and the heat generation span can be set to the span Lb. As described above, in the third embodiment, the heater 22 can heat three different spans in the longitudinal direction, that is, have heating ranges corresponding to a small size sheet, a medium size sheet, and a large size sheet.

In addition, the heater 22 includes a thermistor 25*c* in addition to the thermistors 25*a* and 25*b* and a thermostat 26*c* in addition to the thermostat 26*a* on the back side of the heater 22.

The thermistor 25*a* detects the temperature of the resistance heat generator 31*d*, one of the resistance heat generators 31*c* to 31*e*, the thermistor 25*b* detects the temperature of the resistance heat generator 31*a*, one of the resistance heat generators 31*a* and 31*g*, and the thermistor 25*c* detects a temperature of the temperature of the resistance heat generator 31*b*, one of the resistance heat generators 31*b* and 31*f* Based on these temperatures, temperature control can be performed. Each of the thermostats 26*a* and 26*b* is disposed so as to straddle two groups of the resistance heat generators to detect an abnormal temperature rise in each group of the resistance heat generators and prevent the fixing belt from overheating.

Figure 11:
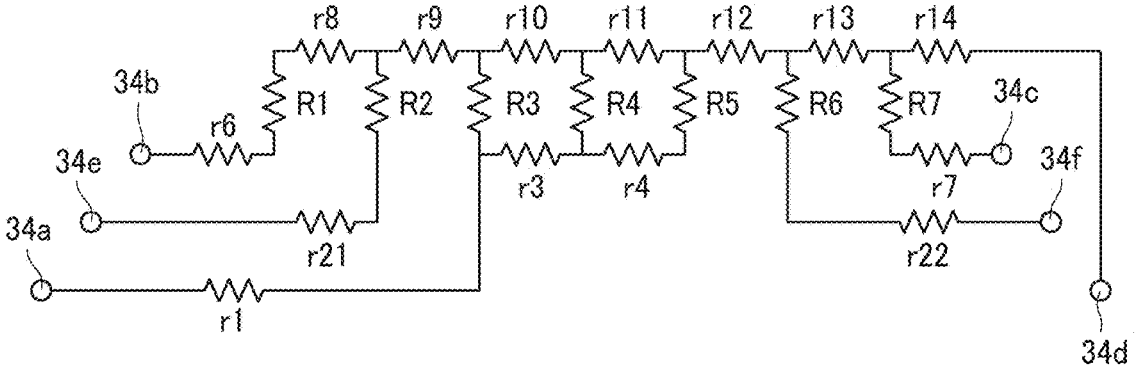
FIG. 11 is an equivalent electric circuit diagram of the heater according to the third embodiment.

FIG. 11 is an equivalent electric circuit diagram of the heater 22 of the third embodiment. Similar to the above-described first embodiment (see FIGS. 4 and 5), the resistance heat generators 31*a* to 31*g* in FIG. 10 correspond to resistances R1 to R7 in FIG. 5, respectively. The conductor path 33*a* corresponds to r1, the conductor paths 33*c* and 33*d* correspond to r3 and r4, respectively, and the conductor paths 33*f* to 33*n* correspond to r6 to r14, respectively. The conductor path 33*q* corresponds to r21, and the conductor path 33*r* corresponds to r22.

Resistances between the electrodes when the power is supplied to the resistance heat generators 31*a* to 31*g* are described bellow.

$$31a{:}r6+R1+r8+r9+r10+r11+r12+r13+r14 \quad \text{(Formula 8)}$$

$$31b{:}r21+R2+r9+r10+r11+r12+r13+r14 \quad \text{(Formula 9)}$$

$$31c{:}r1+R3+r10+r11+r12+r13+r14 \quad \text{(Formula 10)}$$

$$31d{:}r1+r3+R4+r11+r12+r13+r14. \quad \text{(Formula 11)}$$

$$31e{:}r1+r3+r4+R5+r12+r13+r14 \quad \text{(Formula 12)}$$

$$31f{:}r22+R6+r13+r14 \quad \text{(Formula 13)}$$

$$31g{:}r7+R7+r14 \quad \text{(Formula 14)}$$

In the third embodiment, as illustrated in FIG. 10, cross-sectional areas of the branch conductor paths 33*c* and 33*d*, 33*h* to 33*m* are set to be larger than those of the main conductor paths 33*a*, 33*f*, 33*g*, 33*n*, 33*q*, and 33*r* to reduce each resistance per unit length.

Extracting only resistance factors having large resistances from the formulas 8 to 14 that are the resistances between the electrodes when the power is supplied to the resistance heat generators 31*a* to 31*g* gives following formulas.

$$31a{:}r6+R1+r14 \quad \text{(Formula 8')}$$

$$31b{:}r21+R2+r14 \quad \text{(Formula 9')}$$

$$31c{:}r1+R3+r14 \quad \text{(Formula 10')}$$

$$31d{:}r1+R4+r14 \quad \text{(Formula 11')}$$

$$31e{:}r1+R5+r14 \quad \text{(Formula 12')}$$

$$31f{:}r22+R6+r14 \quad \text{(Formula 13')}$$

$$31g{:}r7+R7+r14 \quad \text{(Formula 14')}$$

Therefore, also in the third embodiment, the difference of resistances among the Formulas 8' to 14' can be reduced, that is, the resistances between the electrodes when the power is supplied to the resistance heat generators 31*a* to 31*g* can be set almost the same. Therefore, the above-described configuration can decrease unevenness in the amounts of heat generated by the resistance heat generators 31*a* to 31*g*, and the heater 22 can uniformly heat the fixing belt over the longitudinal direction of the fixing belt.

In the above-described configuration that can turn on or off the group of the resistance heat generators 31*b* and 31*f* that are the second resistance heat generators from both ends in the longitudinal direction independently from other groups of the resistance heat generators, similar to the second embodiment illustrated in FIG. 6, extending the conductor paths 33*g* and 33*r* of the resistance heat generators 31*f* and 31*g* from the other end portion to the one end portion in the longitudinal direction and connecting the electrodes 34*e* and 34*b*, respectively can make the heater 22 without the electrodes 34*c* and 34*f*.

The present disclosure is not limited to the details of the embodiments described above, and various modifications and improvements are possible in ranges without departing from the gist of the present disclosure.

Figure 12:
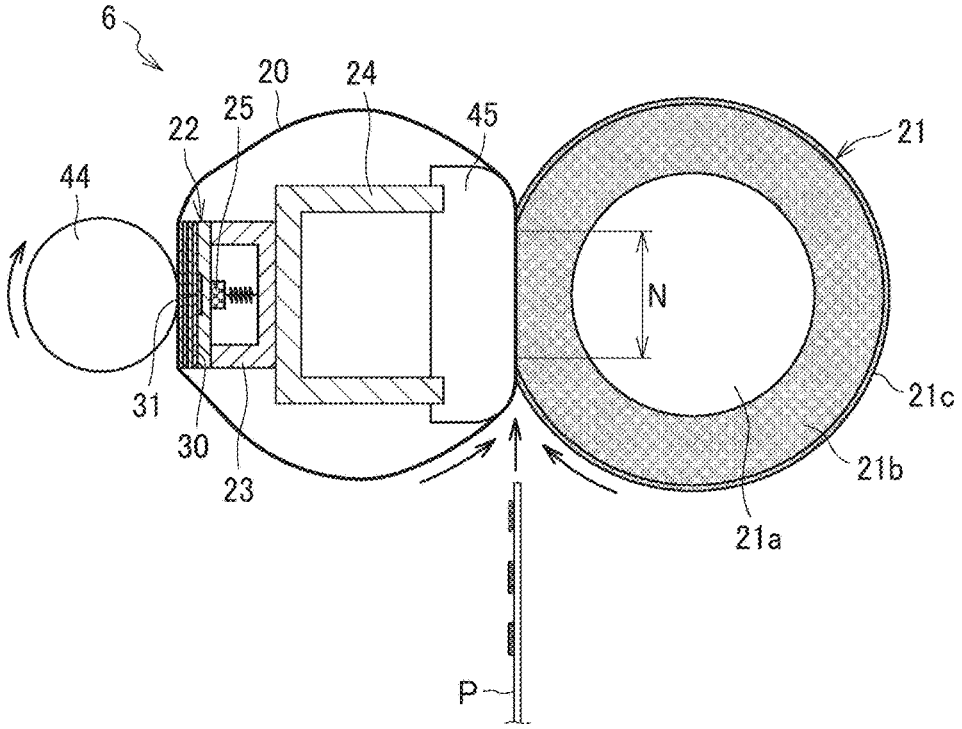
FIG. 12 is a schematic diagram illustrating a configuration of another fixing device.
Figure 13:
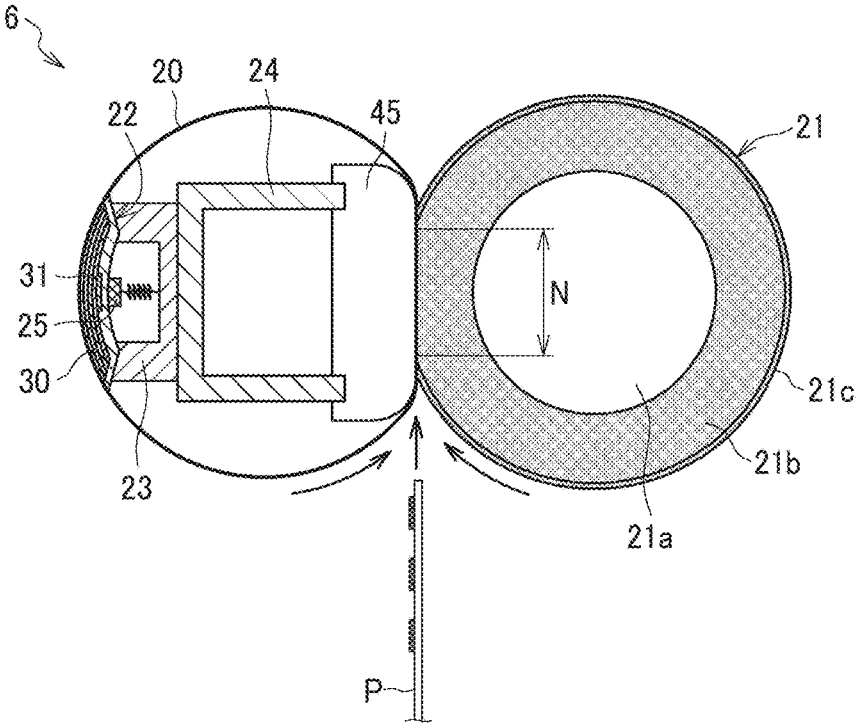
FIG. 13 is a schematic diagram illustrating a configuration of still another fixing device.
Figure 14:
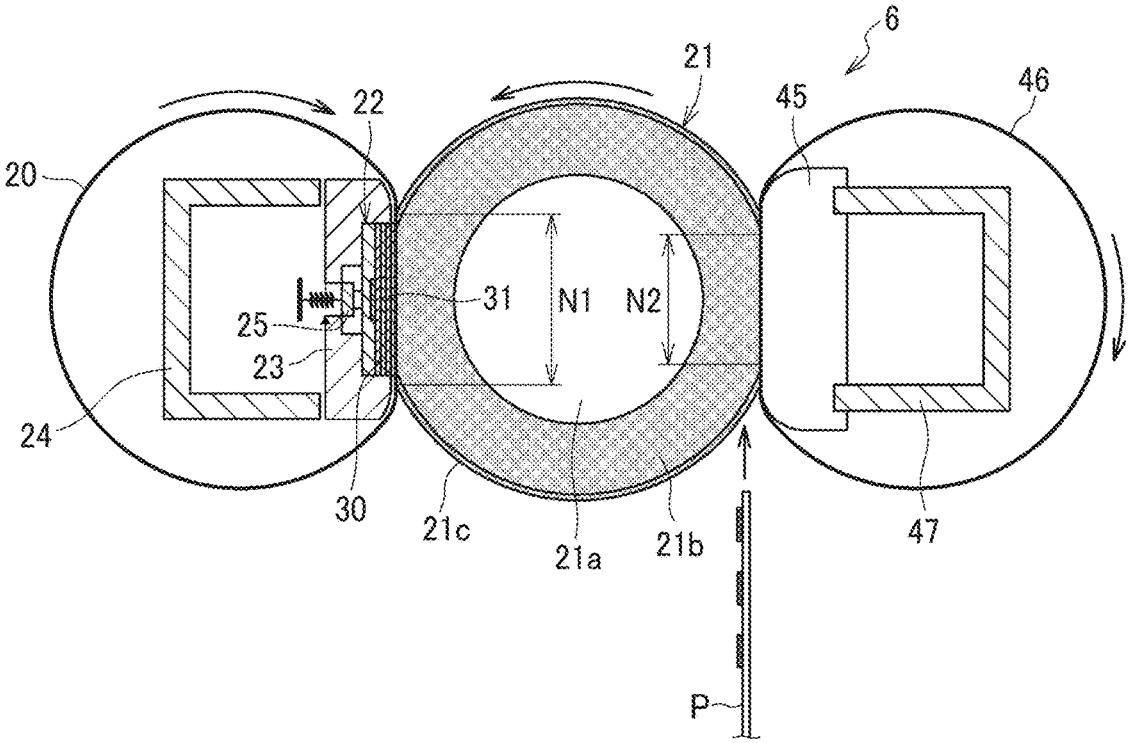
FIG. 14 is a schematic diagram illustrating a configuration of still yet another fixing device.

The heater of the present disclosure can be applied not only to the fixing device illustrated in FIG. 2 but also to, for example, fixing devices illustrated in FIGS. 12 to 14. Referring now to FIGS. 12 to 14, a description is given of some variations of the fixing devices.

First, the fixing device 6 illustrated in FIG. 12 includes a pressurization roller 44 opposite the pressure roller 21 with respect to the fixing belt 20 and heats the fixing belt 20 sandwiched by the pressurization roller 44 and the heater 22. On the other hand, a nip formation pad 45 serving as a nip former is disposed inside the loop formed by the fixing belt 20 and disposed opposite the pressure roller 21. The stay 24 supports the nip formation pad 45. The nip formation pad 45 and the pressure roller 21 sandwich the fixing belt 20 and define the fixing nip N.

Next, the fixing device 6 illustrated in FIG. 13 omits the above-described pressurization roller 44 and includes the heater 22 formed to be arc having a curvature of the fixing belt 20 to keep a circumferential contact length between the fixing belt 20 and the heater 22. Other parts of the fixing device 6 illustrated in FIG. 13 are the same as the fixing device 6 illustrated in FIG. 12.

Lastly, the fixing device 6 illustrated in FIG. 14 includes a pressing belt 46 in addition to the fixing belt 20 and has a heating nip (a first nip) N1 and the fixing nip (a second nip) N2 separately. That is, the nip formation pad 45 and the stay 47 are disposed opposite the fixing belt 20 with respect to the pressure roller 21, and the pressing belt 46 is rotatably arranged to wrap around the nip formation pad 45 and the stay 47. The sheet P passes through the fixing nip N2 between the pressing belt 46 and the pressure roller 21 and is applied to heat and pressure, and the image is fixed on the sheet P. Other parts of the fixing device 6 illustrated in FIG. 14 are the same as the fixing device 6 illustrated in FIG. 2.

In the fixing devices 6 described above, applying the heater 22 according to the embodiment of the present disclosure described above enables the heater 22 to uniformly heat the fixing belt 20 over a sheet conveyance span in the longitudinal direction of the fixing belt 20.

Figure 15:
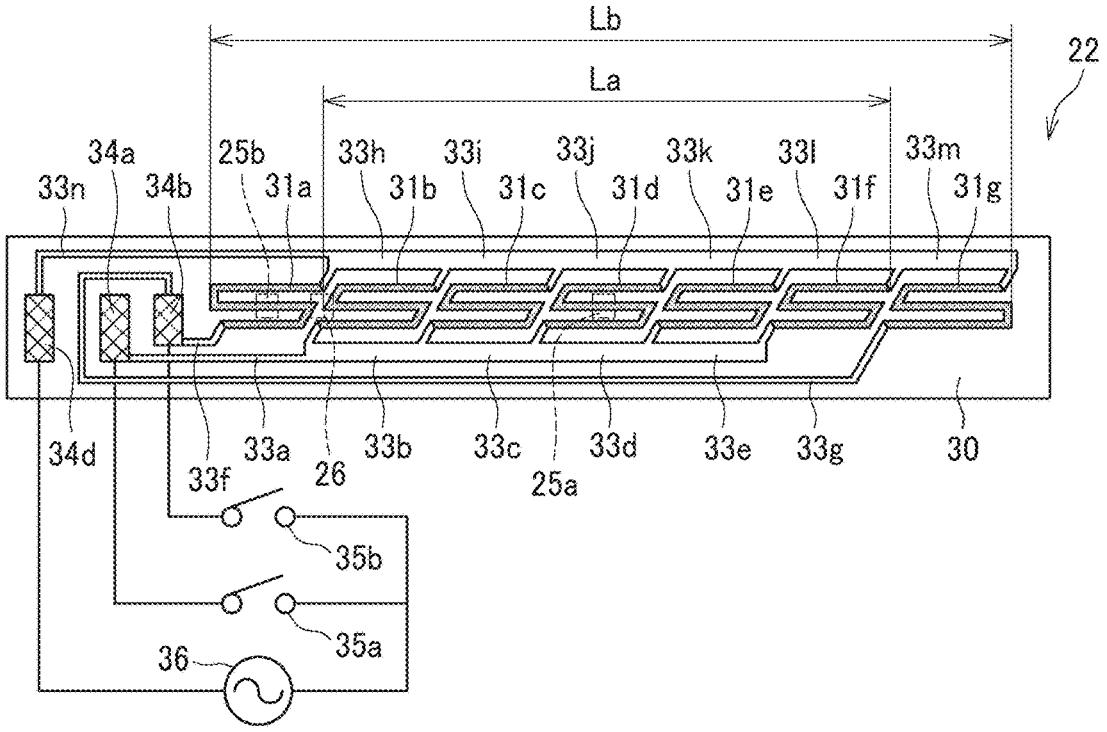
FIG. 15 is a schematic diagram illustrating a circuit to supply power to the heater including electrodes disposed an end portion in a longitudinal direction of the heater.

Although the heater 22 in the above-described embodiments includes electrodes disposed at both end portions of the base 30 in the longitudinal direction of the base 30, the heater 22 may include all electrodes at one end portion of the base in the longitudinal direction. For example, as illustrated in FIG. 15, the electrode 34*d* may be provided on the same side as the electrodes 34*a* and 34*b*. In this case, the conductor path 33*n* connected to the electrode 34*d* extends to one side in the longitudinal direction that is a left side in FIG. 15. For example, the current path the resistance heat generator 31*a* is as follows: the electrode 34*b*→ the conductor path 33*f*→the resistance heat generator 31*a*→ the conductor path 33*n*→ the electrode 34*d*, and the current path of the resistance heat generator 31*b* is as follows: the electrode 34*a*→ the conductor path 33*a*→ the resistance heat generator 31*b* the conductor path 33*h*→ the conductor path 33*n*→ the electrode 34*d*.

In the above-described heater 22, setting the resistances per unit length of the branch conductor paths 33*b* to 33*e* and 33*h* to 33*m* lower than those of the main conductor paths 33*a*, 33*f*, 33*g* and 33*n* can reduce the difference between the resistances of the current paths of the resistance heat generators and unevenness in the heat generated by the heater 22 in the longitudinal direction.

The image forming apparatus according to the present disclosure is applicable not only to the monochrome image forming apparatus illustrated in FIG. 1 but also to a color image forming apparatus, a copier, a printer, a facsimile machine, or a multifunction peripheral including at least two functions of the copier, printer, and facsimile machine.

The above embodiments are examples in which the heater of the present disclosure is applied to the fixing device. However, the heater of the present disclosure may also be applied to a drying device to dry a material to be dried. For example, in an inkjet type image forming apparatus, the heater of the present disclosure may be applied to a drying device that dries an ink image formed on the surface of the recording medium such as the sheet.

The sheets P serving as recording media may be thick paper, postcards, envelopes, plain paper, thin paper, coated paper, art paper, tracing paper, overhead projector (ORP) transparencies, plastic film, prepreg, copper foil, and the like.

In the above embodiments, the method of changing the cross-sectional area of the conductor path is changing both the vertical width and the thickness of the conductor path but may be changing any one of the vertical width and the thickness of the conductor path. Alternatively, changing material of the conductor path, the resistances of a part of or an entire of the branch conductor path may be set lower than that of the main conductor path.

In the above embodiments, the cross-sectional area of the branch conductor path is increased by uniformly enlarging the cross-section of the branch conductor from the cross-section of the main conductor path but may be increased by enlarging only a part of the cross-section of the branch conductor path.

The heater in the above embodiments includes seven resistance heat generators in the longitudinal direction, but the number of resistance heat generators may be lower than or equal to six or greater than or equal to eight.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A heater, comprising:

a base;

a plurality of heat generators arranged above the base in parallel to a longitudinal direction of the base;

a plurality of electrodes arranged above the base; and conductor paths disposed above the base, each of the conductor paths electrically connected to one of the plurality of heat generators and two electrodes of the plurality of electrodes, each of the conductor paths constituting current paths including: two main conductor paths, each connected directly to one electrode of the two electrodes, and one or more branch conductor paths electrically connected to the one of the plurality of heat generators, wherein all resistance values of the one or more branch conductor paths are smaller than all resistance values of the two main conductor paths in each of the constituted current paths.

2. The heater of claim 1, wherein a thickness of one of the one or more branch conductor paths is larger than a thickness of one of the two main conductor paths.

3. A fixing device, comprising:

a first rotator;

a second rotator, a nip being formed between the first rotator and the second rotator; and the heater of claim 2, configured to heat at least one of the first rotator and the second rotator.

4. An image forming apparatus, comprising the fixing device of claim 3.

5. The heater of claim 1, wherein a width of one of the one or more branch conductor paths is larger than a width of one of the two main conductor paths.

6. A fixing device, comprising:

a first rotator;

a second rotator, a nip being formed between the first rotator and the second rotator; and the heater of claim 5, configured to heat at least one of the first rotator and the second rotator.

7. An image forming apparatus, comprising the fixing device of claim 6.

8. The heater of claim 1, wherein the one or more branch conductor paths are made of a material having a lower electrical resistivity than the two main conductor paths.

9. A fixing device, comprising:

a first rotator;

a second rotator, a nip being formed between the first rotator and the second rotator; and the heater of claim 1, configured to heat at least one of the first rotator and the second rotator.

10. The fixing device of claim 9, further comprising:

a switch to turn on or off connection between a power supply, and one of the plurality of electrodes.

11. An image forming apparatus, comprising the fixing device of claim 9.

12. The heater of claim 1, further comprising:

a glass protective layer disposed on a surface of the base, wherein the plurality of heat generators, the plurality of electrodes and the conductor paths are disposed on the glass protective layer.

13. A fixing device, comprising:

a first rotator;

a second rotator, a nip being formed between the first rotator and the second rotator; and the heater of claim 12, configured to heat at least one of the first rotator and the second rotator.

14. An image forming apparatus, comprising the fixing device of claim 13.

15. The heater of claim 1, wherein each of the plurality of heat generators has an elongated turned-back serpentine line configuration.

16. The heater of claim 1, wherein at least one of the one or more branch conductor paths has a electrical resistance per unit length than an electrical resistance per unit length of each of the two main conductor paths.

17. The heater of claim 1, wherein at least one main conductor path is directly connected to one of the plurality of heat generators.

18. The heater of claim 1, wherein at least two of the branch conductor paths are directly connected to each other.

* * * * *